United States Patent [19]

Moss et al.

[11] Patent Number: 4,656,686

[45] Date of Patent: Apr. 14, 1987

[54] PLASTIC FRAME FOR DUST MOPS

[75] Inventors: Ted C. Moss; William H. Kenney, both of Cleveland; Earl V. Boing, Jr., McDonald; H. Edwin Cross, Sr., Cleveland, all of Tenn.

[73] Assignee: Seco Industries, Inc., Cleveland, Tenn.

[21] Appl. No.: 795,764

[22] Filed: Nov. 7, 1985

[51] Int. Cl.[4] ..... A47L 13/255

[52] U.S. Cl. ..... 15/147 A; 15/228; 15/229 BP

[58] Field of Search ..... 15/147 R, 147 A, 147 B, 15/228, 229 R, 229 A, 229 AC, 229 AP, 229 B, 229 BC, 229 BP; 300/21

[56] References Cited

U.S. PATENT DOCUMENTS

| | | | |
|---|---|---|---|
| 3,029,454 | 4/1962 | Short et al. | 15/147 R |
| 3,704,480 | 12/1972 | Whitaker | 15/144 R |
| 3,711,886 | 1/1973 | Strauss | 15/229 BP |
| 3,775,802 | 12/1973 | Grassman et al. | 15/147 A |
| 4,165,550 | 8/1979 | Burke | 15/229 BP |
| 4,580,307 | 4/1986 | Moss | 15/228 X |

FOREIGN PATENT DOCUMENTS

| | | | |
|---|---|---|---|
| 2611615 | 9/1977 | Fed. Rep. of Germany | 15/229 BP |

*Primary Examiner*—Edward L. Roberts

*Attorney, Agent, or Firm*—Renner, Otto, Boisselle & Lyon

[57] ABSTRACT

Dust mop frame includes a plastic molded base member having a substantially flat bottom surface for applying uniform pressure over substantially the entire surface of the dust mop and a rigid hinge member securely molded in place in spaced relation to the back side of the base member to facilitate attachment of a handle to the dust mop frame. The hinge member is supported adjacent its ends by a pair of laterally spaced, transversely extending ribs integrally molded to the back side of the base member. The ends of the hinge member extend completely through the transverse ribs into a pair of longitudinally extending ribs integral with the axial outer sides of the transverse ribs intermediate the ends thereof and also integral with a peripheral rib around the outer edge of the base member. The ends of the hinge member then extend downwardly and inwardly back on themselves at an angle, and are of a length such that they extend vertically within the longitudinal ribs for a substantial portion of the height thereof and back into the transverse ribs adjacent the base member.

16 Claims, 5 Drawing Figures

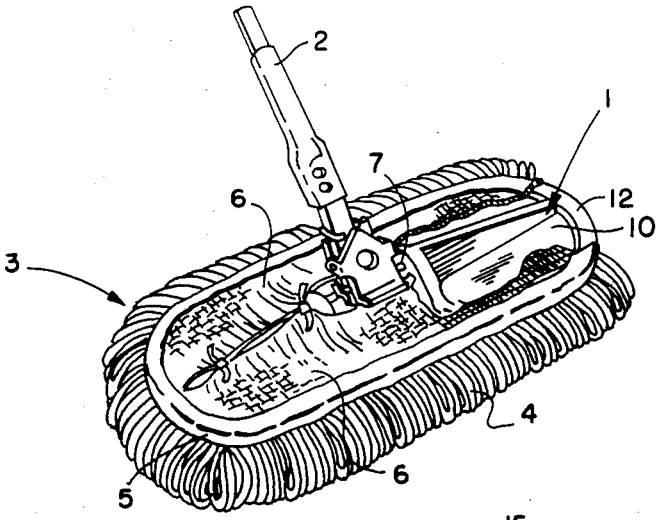
FIG. 1
FIG. 2
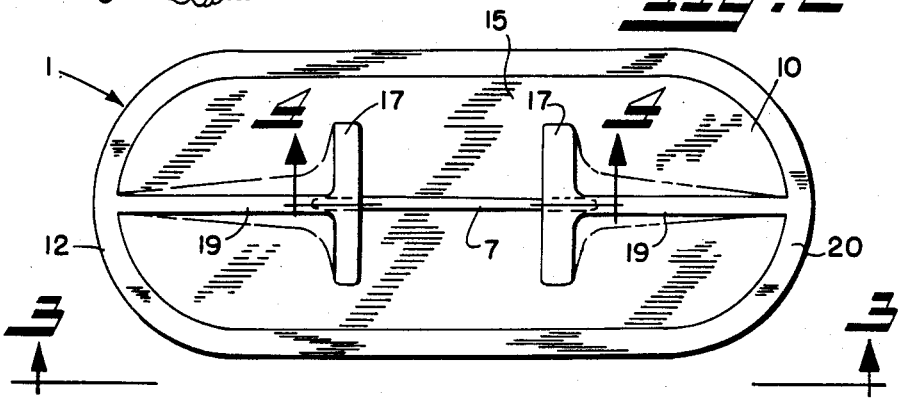
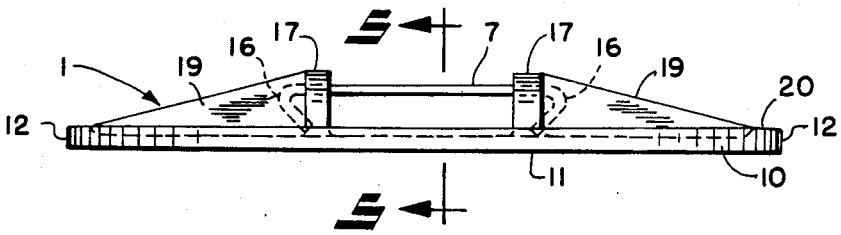
FIG. 3
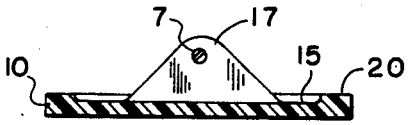
FIG. 5
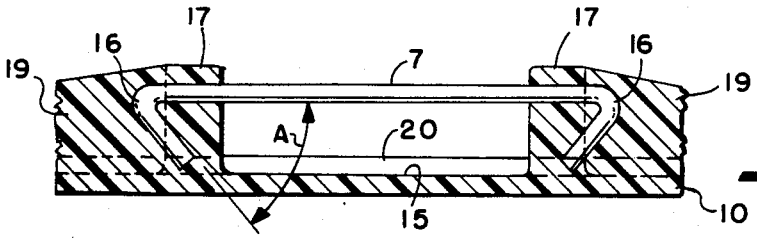
FIG. 4

PLASTIC FRAME FOR DUST MOPS

BACKGROUND OF THE INVENTION

This invention relates generally as indicated to a plastic frame for dust mops, including particularly a solid base member having a flat bottom surface for applying uniform pressure over substantially the entire surface of the dust mop to help maximize the amount of dust mop yarn surface on the floor for better cleaning, and a rigid hinge member securely molded in place in spaced relation to the back side of the base member to facilitate attachment of a handle to the dust mop frame.

Heretofore, it was common practice to utilize a rigid open metal wire frame for supporting a dust mop and attaching same to a handle. However, not only are such open wire frames relatively expensive to manufacture, but they have the added drawback that they only apply pressure to a relatively small portion of the total area of the mop surface, i.e., to that portion which is directly engaged by the wire frame. As a consequence, the weight distribution over the mop surface is not very even, which is important in order to maximize the amount of mop yarn in contact with the floor.

In U.S. Pat. No. 3,704,480, there is shown a plastic molded mop head including a generally flat plate to which a sponge-like material is attached by adhesive or other suitable means. However, up to now mop heads of this type have not been used with conventional dust mops which may, for example, be anywhere from 12 inches to 48 inches long, to apply uniform pressure over substantially the entire surface of the dust mop to help maximize the amount of dust mop yarn surface on the floor for better cleaning. Also, the mop head and associated handle mount of such patent do not appear to be designed to take the heavy loads that may be encountered with the larger dust mops.

SUMMARY OF THE INVENTION

With the foregoing in mind, it is a principal object of this invention to provide a relatively light weight dust mop frame which applies uniform pressure over substantially the entire surface of a conventional dust mop to maximize the amount of mop yarn in contact with the floor for better cleaning.

In accordance with one aspect of the invention, the dust mop frame includes a base member which is molded as a solid piece out of a suitable plastic material to provide a substantially flat bottom surface for applying uniform pressure over substantially the entire surface of the dust mop.

In accordance with another aspect of the invention, a rigid hinge member is securely molded in place in spaced relation to the back side of the base member to facilitate attachment of a handle to the dust mop frame. The hinge member is supported adjacent its ends by a pair of laterally spaced, transversely extending ribs integrally molded to the back side of the base member. The ends of the hinge member desirably extend completely through the transverse ribs into a pair of longitudinally extending ribs integral with the axial outer sides of the transverse ribs intermediate the ends thereof and also integral with the base member. The ends of the hinge member then extend downwardly and inwardly back on themselves at an angle, and are of a length such that they extend vertically within the longitudinal ribs for a substantial portion of the height thereof and back into the transverse ribs adjacent the base member to provide adequate support for the hinge member regardless of which direction a force may be applied to the hinge member and base member through the handle.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a perspective view, partially broken away, of a dust mop assembly including a preferred form of dust mop frame in accordance with this invention shown received within the pocket of a conventional dust mop and having a handle attached thereto;

FIG. 2 is a top plan view of the dust mop frame of the present invention;

FIG. 3 is a side elevation view of the dust mop frame of FIG. 2;

FIG. 4 is an enlarged fragmentary longitudinal section through the dust mop frame of FIG. 2, taken substantially along the plane of the line 4—4 thereof; and FIG. 5 is a reduced transverse section through the dust mop frame of FIG. 3, taken along the plane of the line 5—5 thereof.

DETAILED DESCRIPTION OF THE PREFERRED EMBODIMENT

Referring now in detail to the drawing, wherein like reference numerals are used to designate like parts in the several figures, FIG. 1 shows a preferred form of dust mop frame 1 in accordance with the present invention for use in connecting a handle 2 to a dust mop 3. The dust mop itself may be of any desired type. In the example shown in FIG. 1, the dust mop 3 includes mop yarn 4 sewn to a fabric backing 5. The dust mop frame 1 is attached to the fabric backing 5 beneath tied overlapping cover flaps 6. On the back side of the dust mop frame is a rigid hinge member 7 whch is accessible through the cover to permit attachment of the handle 2 thereto as shown.

Turning now specifically to FIGS. 2–5, the dust mop frame 1 includes a base member 10 molded as a single piece out of a suitable plastic material such as structural foam material. The base member 10 has a flat bottom surface 11 of generally rectangular shape but with rounded ends 12. As will be apparent from FIG. 1, the flat bottom surface of the base member substantially corresponds in size and shape to the fabric backing portion 5 of the dust mop with which it is to be used. This has the advantage that the dust mop frame 1 will keep the dust mop closer to the floor and will apply a more uniform pressure over substantially the entire surface of the mop than was possible with previous known wire dust mop frames. Such even weight distribution helps maximize the amount of dust mop yarn surface in contact with the floor for better cleaning.

Attached to the back side 15 of the base member 10 is the aforementioned rigid hinge member 7 which consists of a pin or shaft made of a suitable metal such as steel. The hinge member 7 is securely molded in place in spaced relation from the back side of the base member as described hereafter to facilitate attachment of a snap-on handle 2 to the dust mop frame.

As clearly shown in FIGS. 2–4, the hinge member 7 is supported adjacent its ends 16 by a pair of laterally spaced transversely extending ribs 17 integrally molded on the back side of the base member. Preferably, the ends 16 of the hinge member extend completely through the transverse ribs 17 into respective longitudinally extending ribs 19 integral with the axial outwardly facing sides of the transverse ribs 17 intermediate the ends thereof and also integral with the base member itself. The ends 16 of the hinge member 7 then extend downwardly and inwardly back on themselves at an angle A of approximately 50°. Also, such downturned ends are desirably of a length such that they extend vertically within a substantial portion of the height of the longitudinal ribs 19 and back into the transverse ribs 17 adjacent the back side 15 of the base member 10 to provide adequate support for the hinge member regardless of which direction a force may be applied to the hinge member through the handle.

The longitudinal ribs 19 gradually taper downwardly from the height of the transverse ribs 17 at their center to the height of a relatively shallow peripheral rib 20 extending all the way around the back side of the base member along the outer edge thereof, such ribs 17, 19, 20 being integrally molded with the base member and with each other. As will be apparent, not only do the transverse and longitudinal ribs 17 and 19 support the hinge member 16, but such ribs also cooperate with the peripheral rib 20 to provide additional strength (support) for the base member itself. The dust mop frame 1, being made out of a suitable plastic material such as structural foam material, is chemically resistant, completely corrosion proof, and stands up indefinitely in continuous commercial use.

The overall length of the dust mop frame may vary, for example, from 12 inches to 48 inches, depending on the length of the dust mop with which it is used. Typically, the dust mop frame may have an overall width of approximately $4\frac{7}{8}$ inches. Also, the base member 10 may have a nominal thickness of approximately $\frac{1}{8}$ inch, and the peripheral rib 20, which extends all the way around the base member, may have a width of approximately $\frac{1}{2}$ inch and a height above the back side of the base member of approximately $\frac{1}{4}$ inch.

The transverse ribs 17 are symmetrically located on the base member, and may be approximately $\frac{1}{2}$ inch wide and 15/16 inch high at their center, from which they gradually taper downwardly in opposite directions to blend into the back side of the base member where they have a maximum length of approximately $2\frac{3}{4}$ inches. Also, the transverse ribs are desirably spaced apart approximately $3\frac{1}{4}$ inches.

Likewise, the maximum height of the longitudinal ribs 19 at the axial inner ends thereof is desirably the same as the maximum height of the transverse ribs at their midpoints, and such longitudinal ribs gradually taper downwardly to the $\frac{1}{4}$ inch height of the peripheral rib 20. Also, the sides of the longitudinal ribs desirably gradually taper downwardly and outwardly from a minimum width of approximately $\frac{1}{4}$ inch at the top to a maximum width of approximately $\frac{3}{4}$ inch at the base. The axial inner ends of the longitudinal ribs are desirably rounded out to blend with the axially outwardly facing sides of the transverse ribs.

The hinge member 7 may be made from a 3/16 inch diameter steel shaft or rod, and desirably extends between the transverse ribs 17 at their midpoints at a height of approximately $\frac{5}{8}$ inch from the base member (or approximately 5/16 inch below the maximum height of the transverse ribs). Furthermore, such hinge member desirably extends axially completely through the transverse ribs 17 and into the longitudinal ribs 19 for a distance of approximately $\frac{3}{8}$ inch, at which point the ends of the hinge member extend vertically downwardly and inwardly within the longitudinal ribs at an included angle of approximately 50° until they once again enter the transverse ribs at the same 50° angle, terminating adjacent the bottom center of such transverse ribs.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A dust mop frame for use in supporting a dust mop and providing an attachment for connecting the dust mop to a handle comprising a plastic molded base member having a flat bottom surface for applying uniform pressure over substantially the entire surface of the mop and a back side opposite said bottom surface, a rigid hinge member, and mounting means for securely mounting said hinge member in spaced relation to said back side of said base member for use in attaching a handle to the base member, said mounting means comprising a pair of transverse ribs integrally molded to said back side of said base member, and longitudinal ribs integrally molded to the back side of said base member and to the axial outer sides of said transverse ribs intermediate the length of said transverse ribs, said hinge member having ends molded in place in said transverse ribs and longitudinal ribs, said ends of said hinge member extending completely through said transverse ribs and into said longitudinal ribs and extending downwardly and inwardly back on themselves at an angle towards the back side of said base member and within said longitudinal ribs for a substantial portion of the height of said longitudinal ribs.

2. The dust mop frame of claim 1 wherein said ends of said hinge member also extend back into said transverse ribs adjacent the back side of said base member.

3. The dust mop frame of claim 2 wherein said ends of said hinge member extend into said transverse ribs at an angle of approximately 50°.

4. The dust mop frame of claim 1 further comprising a shallow peripheral rib extending all the way around said back side only of said base member along the outer edge thereof.

5. The dust mop frame of claim 4 wherein the maximum height of said transverse ribs is substantially greater than the height of said peripheral rib, and said longitudinal ribs gradually taper downwardly from the maximum height of said transverse ribs to the height of said peripheral rib.

6. The dust mop frame of claim 5 wherein said longitudinal ribs are also integral with said peripheral rib.

7. The dust mop frame of claim 5 wherein said longitudinal ribs have outwardly tapering sides from top to bottom.

8. The dust mop frame of claim 1 wherein said transverse ribs have a maximum height at the center of the length of said transverse ribs, and said transverse ribs gradually taper downwardly on opposite sides of said center to blend into the back side of said base member.

9. The dust mop frame of claim 1 wherein said transverse ribs are symmetrically located on the back side of said base member, and said longitudinal ribs extend from the center of said transverse ribs to the adjacent ends of said base member.

10. The dust mop frame of claim 9 further comprising a shallow peripheral rib extending all the way around the back side only of said base member along the outer edge thereof, said longitudinal ribs gradually tapering downwardly from the center height of said transverse ribs to the height of said peripheral rib.

11. A dust mop frame for use in supporting a dust mop and providing an attachment for connecting the dust mop to a handle comprising a plastic molded base member, a rigid hinge member, and mounting means for securely mounting said hinge member in spaced relation to one side of said base member for use in attaching a handle to said base member, said mounting means comprising a pair of transverse ribs integrally molded to said one side of said base member, and longitudinal ribs also integrally molded to said one side of said base member and to the axial outer sides of said transverse ribs intermediate the length of said transverse ribs, said hinge member having ends molded in place in said transverse ribs and longitudinal ribs, said ends of said hinge member extending completely through said transverse ribs and into said longitudinal ribs, said ends of said hinge member extending downwardly and inwardly back on themselves at an angle towards said one side of said base member and within said longitudinal ribs for a substantial portion of the height of said longitudinal ribs.

12. A dust mop assembly comprising a dust mop and dust mop frame, said dust mop including a fabric backing, dust mop yarns on one side of said fabric backing, and means for securing said fabric backing to said dust mop frame, said dust mop frame comprising a plastic molded base member having a flat bottom surface in engagement with the side of said fabric backing opposite said dust mop yarns, said flat bottom surface being of a size and shape substantially corresponding to that of said fabric backing for applying uniform pressure over substantially the entire mop surface to help maximize the amount of dust mop yarns on the surface being cleaned for better cleaning, a rigid hinge member, and mounting means for securely mounting said hinge member in spaced relation to the back side of said base member opposite said flat bottom surface for use in attaching a handle to said base member, said mounting means comprising a pair of transverse ribs integrally molded to the back side of said base member, said hinge member having ends molded in place in said transverse ribs, and longitudinal ribs integrally molded to the back side of said base member and to the axial outer sides of said transverse ribs intermediate the length of said transverse ribs, the ends of said hinge member extending completely through said transverse ribs and into said longitudinal ribs, said ends of said hinge member being bent downwardly and inwardly back on themselves and extending vertically within said longitudinal ribs for a substantial portion of the height of said longitudinal ribs.

13. The dust mop assembly of claim 12 wherein said bent ends of said hinge member extend back into said transverse ribs adjacent the back side of said base member.

14. The dust mop assembly of claim 13 further comprising a shallow peripheral rib extending all the way around the back side only of said base member along the outer edge thereof, said longitudinal ribs blending into the respective transverse ribs and into said peripheral rib at opposite ends of said longitudinal ribs.

15. The dust mop assembly of claim 14 wherein the maximum height of said transverse ribs at their center is substantially greater than the height of said peripheral rib, and said longitudinal ribs gradually taper downwardly from the maximum height of said transverse ribs at their center to the height of said peripheral rib, said longitudinal ribs being integral with the back side of said base member and with said transverse ribs and said peripheral rib.

16. The dust mop assembly of claim 12 wherein the back side only of said base member has a peripheral rib extending all the way around said base member along the outer edge thereof, said transverse ribs have a maximum height at the center of the length of said transverse ribs which is substantially greater than the height of said peripheral rib, and said longitudinal ribs gradually taper downwardly from the maximum height of said transverse ribs to the height of said peripheral rib, said longitudinal ribs also being integral with said peripheral rib.

* * * * *